US011165167B2

(12) United States Patent
Rentz

(10) Patent No.: US 11,165,167 B2
(45) Date of Patent: Nov. 2, 2021

(54) ANTENNA SYSTEM FOR CIRCULARLY POLARIZED SIGNALS

(71) Applicant: Deere & Company, Moline, IL (US)

(72) Inventor: Mark L. Rentz, Torrance, CA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 16/784,985

(22) Filed: Feb. 7, 2020

(65) Prior Publication Data

US 2021/0249786 A1 Aug. 12, 2021

(51) Int. Cl.

| | |
|---|---|
| ***H01Q 21/06*** | (2006.01) |
| ***H01Q 9/32*** | (2006.01) |
| ***H01Q 1/38*** | (2006.01) |
| ***H01Q 1/22*** | (2006.01) |
| ***H01Q 9/26*** | (2006.01) |

(52) U.S. Cl.

CPC ..... *H01Q 21/062* (2013.01); *H01Q 1/22* (2013.01); *H01Q 1/38* (2013.01); *H01Q 9/26* (2013.01); *H01Q 9/32* (2013.01)

(58) Field of Classification Search

CPC ..... H01Q 21/062; H01Q 9/32; H01Q 9/26; H01Q 1/22; H01Q 1/38

See application file for complete search history.

(56) References Cited

U.S. PATENT DOCUMENTS 6,211,840 B1 4/2001 Wood et al.
7,432,872 B1 * 10/2008 Waller ..... H01Q 11/10 343/705
7,990,329 B2 * 8/2011 Deng ..... H01Q 1/246 343/757
8,803,748 B2 * 8/2014 Lim ..... H01Q 1/38 343/713
2009/0174620 A1 7/2009 Kim et al.
2010/0253587 A1 10/2010 Lindenmeier et al.
(Continued)

FOREIGN PATENT DOCUMENTS

CN 109474324 A 3/2019

OTHER PUBLICATIONS

Charles D. McCarrick et al., A Combination Monopole/Quadrifilar Helix Antenna for S-band Terrestrial/Satellite Applications, Microwave Journal, May 1, 2001, pp. 12, [online], [retrieved on Feb. 11, 2020]. Retrieved from the Internet <URL: https://www.microwavejournal.com/articles/3206-a-combination-monopole-quadrifilar-helix-antenna-for-s-band-terrestrial-satellite-applications>.
(Continued)

*Primary Examiner* — Andrea Lindgren Baltzell

(57) ABSTRACT

In one embodiment, a first antenna element has a substantially vertical axis. An array of second antenna elements is configured to radiate or receive an aggregate radially polarized electromagnetic signal component. The array defines a substantially horizontal plane that is generally orthogonal to the substantially vertical axis of the first antenna element. The aggregate radially polarized electromagnetic signal is derived from radially polarized electromagnetic signal components associated with corresponding ones of the second antenna elements. The aggregate radially polarized electromagnetic signal is derived from radially polarized electromagnetic signal components associated with corresponding ones of the second antenna elements.

12 Claims, 5 Drawing Sheets

(56) References Cited

U.S. PATENT DOCUMENTS

| | | | |
|---|---|---|---|
| 2011/0260939 | A1 | 10/2011 | Korva et al. |
| 2017/0040702 | A1 | 2/2017 | West et al. |

OTHER PUBLICATIONS

Jorge Simón et al., A Microstrip Second-Iteration Square Koch Dipole Antenna for TT&C Downlink Applications in Small Satellites, International Journal of Antennas and Propagation, Mar. 9, 2017, pp. 8, [online], [retrieved on Feb. 11, 2020]. Retrieved from the Internet <URL: https://www.hindawi.com/journals/ijap/2017/4825179/> <10.1155/2017/4825179>.

G. Rushingabigwi et al., Design of a printed circuit board antenna for multiple utilizations in IEEE802.16a spectrum and beyond, IEEE Xplore Digital Library, Aug. 8-11, 2016, pp. 1, [online], [retrieved on Feb. 11, 2020]. Retrieved from the Internet <URL: https://ieeexplore.ieee.org/abstract/document/7734506><DOI: 10.1109/PIERS.2016.7734506>.

Inverted-F antenna, pp. 7, [online], [retrieved on Feb. 11, 2020]. Retrieved from the Internet <URL: https://en.wikipedia.org/wiki/Inverted-F_antenna>.

High Performance Positioning in High Latitudes, pp. 2, [online], [retrieved on Feb. 11, 2020]. Retrieved from the Internet <URL: https://www.fugro.com/docs/default-source/about-fugro-doc/rovsa12216000mpbra5_sst_arctic_services.pdf?sfvrsn=dde01f1a_0>.

B.S. Geaghan et al, Communications to high latitudes using a commercial low Earth orbit satellite system, IEEE Xplore Digital Library, Apr. 30-May 2, 1996, pp. 1, [online], [retrieved on Feb. 11, 2020]. Retrieved from the Internet <URL: https://ieeexplore.ieee.org/document/561110><DOI: 10.1109/TCC.1996.561110>.

The International Search Report and the Written Opinion of the International Searching Authority issued in counterpart application No. PCT/US21/70110, dated Mar. 31, 2021 (08 pages).

* cited by examiner

ANTENNA SYSTEM FOR CIRCULARLY POLARIZED SIGNALS

FIELD

This disclosure relates to an antenna system for circularly polarized electromagnetic signals, such as an antenna system for a satellite navigation system receiver.

BACKGROUND

In some background art, an antenna system is used for a satellite navigation receiver to receive a satellite signal transmitted by one or more satellites in orbit around the Earth. For example, if satellite is in a geostationary orbit over the equator and the satellite receiver on Earth is at a higher latitude that is very far North or very far South of the equator, the typical radiation pattern of the antenna system may have insufficient gain for reliable reception of the satellite signal. Here, for the geostationary orbiting satellite over the equator that transmits the satellite signal (e.g., with circular polarization), at the higher latitude the satellite receiver will receive the satellite signal primarily from a low angle that is closer to the horizon than the zenith.

To improve the reception at higher latitudes, there are some antenna configurations with circular polarization that perform well, but such antenna configurations, such as quadrifilar helix and bifilar helix tend be larger than required for satellite navigation receivers to be mounted on vehicles in limited space. Additionally, their helical elements typically must be top fed, leading to a complexity and increased cost. Accordingly, there is a need for a compact antenna system for circularly polarized signals.

SUMMARY

In accordance with on embodiment, an antenna system comprises a first antenna element is configured to radiate or receive a vertically polarized electromagnetic signal component within a target wavelength range. The first antenna element has a substantially vertical axis. An array of second antenna elements is configured to radiate or receive an aggregate radially polarized electromagnetic signal component within the target wavelength range. The array defines a substantially horizontal plane that is generally orthogonal to the substantially vertical axis of the first antenna element. The aggregate radially polarized electromagnetic signal is derived from radially polarized electromagnetic signal components associated with corresponding ones of the second antenna elements. A combining network is configured to combine the received vertically polarized electromagnetic signal component and the aggregate radially polarized electromagnetic signal component such that the first antenna element, the array of second antenna elements, and the combining network cooperate to yield or receive a radiation pattern that is generally circularly polarized at the target wavelength range.

DETAILED DESCRIPTION

Figure 1:
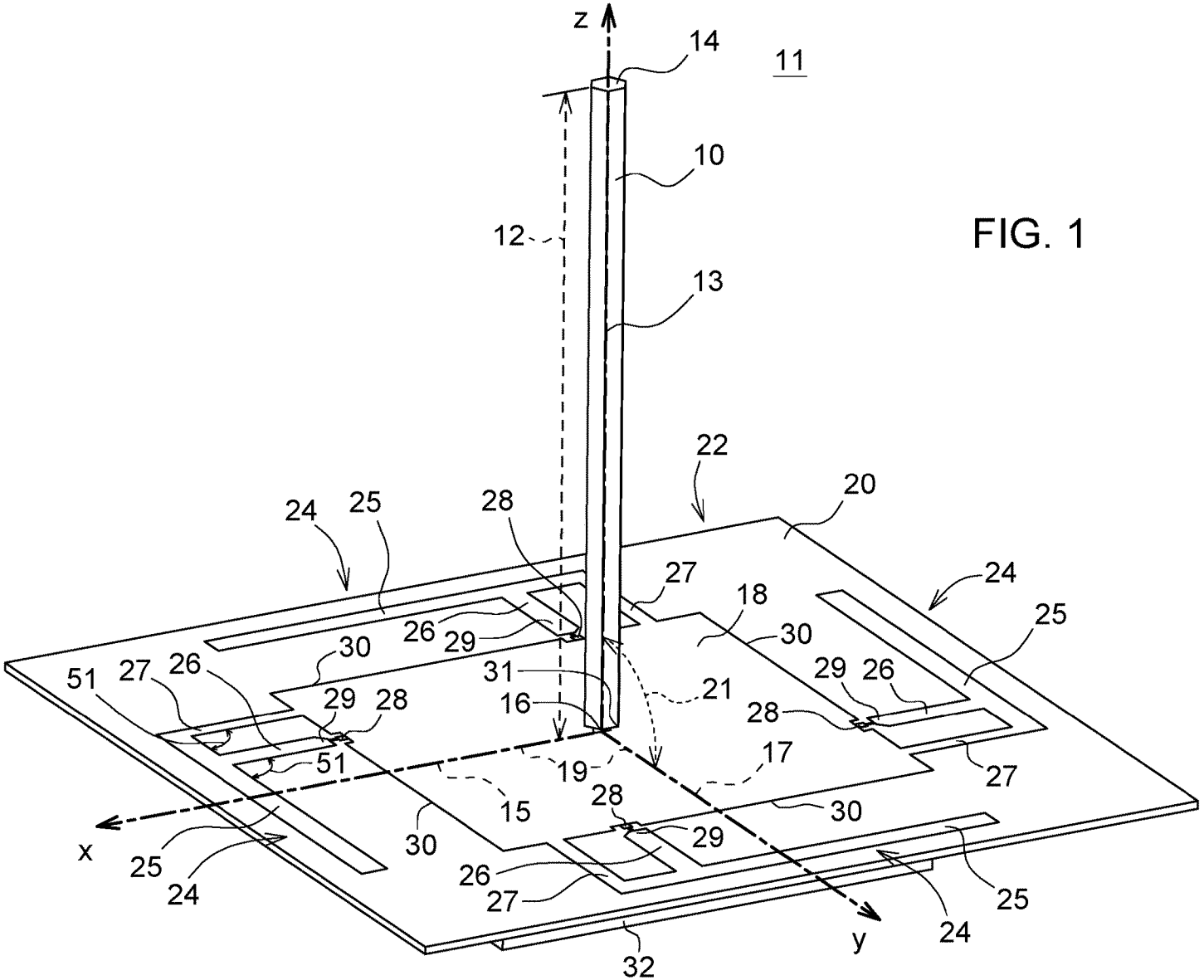
FIG. 1 is a perspective top view of one embodiment of an antenna system that illustrates a first antenna element and an array of second antenna elements.

In accordance with on embodiment, an antenna system 11 comprises a first antenna element 10 that is configured to radiate or receive a vertically polarized electromagnetic signal component 301 (in FIG. 3) within a target wavelength range or an equivalent target frequency range (e.g., of a satellite navigation system). The first antenna element 10 has a substantially vertical axis 13 (e.g., Z-axis). An array of second antenna elements 24 is configured to radiate or receive an aggregate radially polarized electromagnetic signal component 303 (in FIG. 3) within the target wavelength range. The array of second antenna elements 24 defines a substantially horizontal plane 19 that is generally orthogonal to the substantially vertical axis 13 of the first antenna element 10. The substantially or approximately orthogonal angle 21 is between the vertical axis 13 and substantially horizontal plane 19, or between the vertical axis and the depth axis 17, for instance. As illustrated in FIG. 1 and in FIG. 3, the substantially horizontal plane is defined by a plane or generally horizontal surface that intercepts both the lateral axis 15 (X-axis) and the depth axis 17 (Y-axis), where in practice the substantially horizontal plane may be aligned or coextensive with, or substantially parallel to, a circuit board 22 and second antenna elements 24 (which may project above the circuit board by a height of conductive traces or strips that form the second antenna elements 24).

Figure 3:
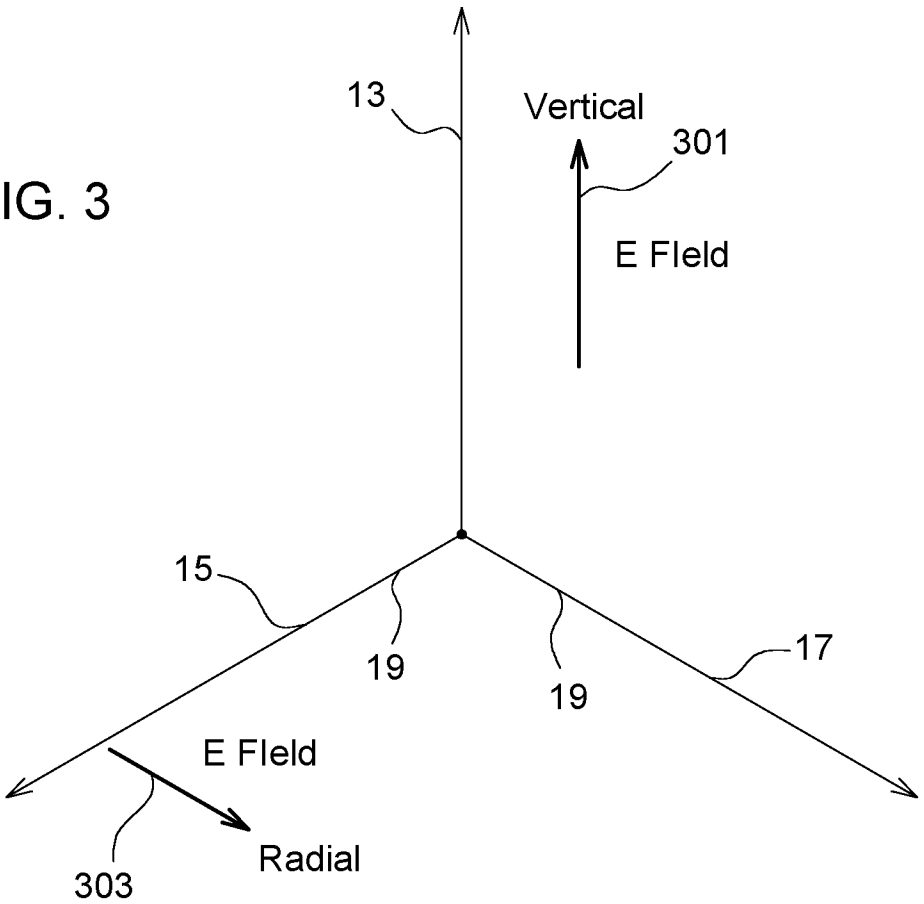
FIG. 3 illustrates the electromagnetic field (e.g., electric field) contributions from a first element and array of second elements in one embodiment of the antenna system.

In one embodiment, an aggregate radially polarized electromagnetic signal is derived from radially polarized electromagnetic signal components 303 (in FIG. 3) associated with corresponding ones of the second antenna elements 24. As illustrated in FIG. 3, the radially polarized electromagnetic signal component 303 may represent a contribution to the electric field from only one of the second antenna elements 24. Different orientations (e.g., generally orthogonal relative orientations) of the array of second antenna elements 24 to each other result in corresponding different orientations of the respective electric fields (not shown) of other second antenna elements 24. For example, if each second antenna element 24 is rotated approximately ninety-degrees about its vertical axis 13 (Z-axis) from any adjacent/neighboring second antenna element 24 as illustrated in FIG. 1, then the electric fields of the respective array second antenna elements 24 are aligned with generally orthogonal relative orientations to adjacent/neighboring ones of each other. In other words, while referring to FIG. 1 and FIG. 3, collectively, the electric field of each second antenna element 24 is rotated or twisted approximately ninety-degree rotation about the vertical axis 13 (Z-axis) for each of the second antenna elements 24.

Figure 2:
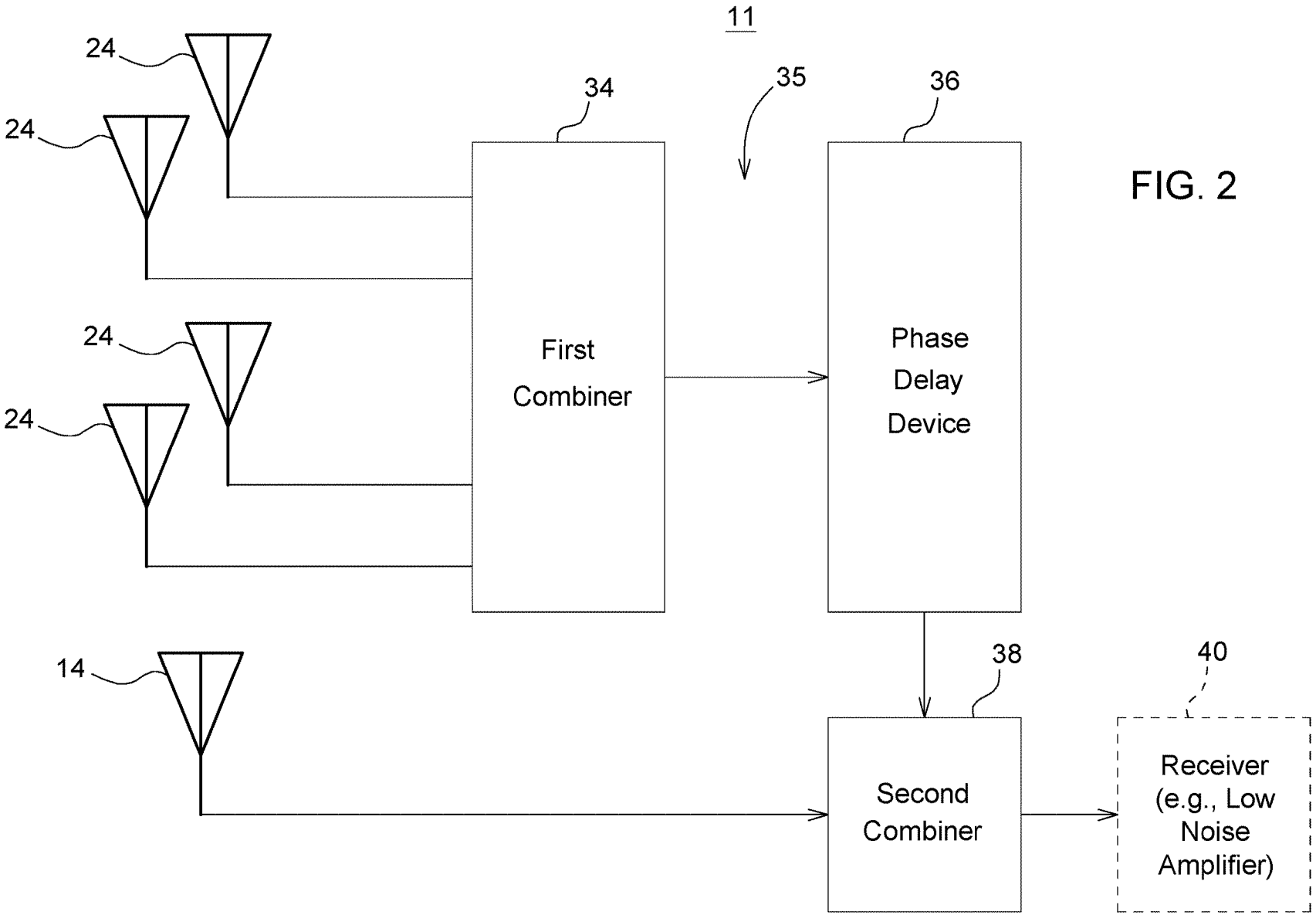
FIG. 2 is a block diagram of one embodiment of a schematic for the antenna system of FIG. 1 that further illustrates the first combiner, the second combiner and a phase delay device.

In FIG. 2, a combining network 35 is configured to combine the received vertically polarized electromagnetic signal component 301 and the aggregate radially polarized signal component (composed of multiple or four radially polarized signal components 303) such that the first antenna element 10, the array of second antenna elements 24, and the combining network 35 cooperate to yield or receive a radiation pattern (e.g., disc-shaped or toroidal radiation pattern 45 in FIG. 4) that is generally circularly polarized at the target wavelength range (e.g., for a satellite navigation system).

In practice, the antenna system 11 is well suited for use in a variety of satellite communication systems and satellite navigation systems, such as the Global Positioning System (GPS), Global Navigation Satellite System (GLONASS) and Galileo Satellite System, because such systems typically use circular polarization for both uplinks (e.g., from the satellite transmitter on Earth to the satellite receiver orbiting above Earth) and downlinks (e.g., from the satellite transmitter orbiting above Earth to the satellite receiver on Earth). The circularly polarized radiation pattern (e.g., disc-shaped or toroidal radiation pattern 45 in FIG. 4) of the antenna system 11 has lower sensitivity to the orientation between the transmit and receive antennas than does linear polarization, where linear polarization can result in substantial attenuation between transmit and receive antennas with misaligned or different linear polarizations (e.g., orthogonally oriented linear polarizations).

In one embodiment, the first antenna element 10 comprises a substantially vertical monopole that is associated with an electrically conductive ground plane 18 on a dielectric substrate 20. For example, the first antenna element 10 (e.g., substantially vertical monopole) can be bottom fed through a first through-hole 16, such as a conductive through-hole or conductive via that is electrically insulated from the electrically conductive ground plane 18 or central ground plane. The first antenna element 10 has an upper end 14 and a lower end 31 (e.g., adjacent or above first through hole 16) opposite the upper end 14. The electrical insulation or isolation, with respect to the first antenna element 10 and the first through-hole 16 that is electrically coupled to the first antenna element 10, may be established by an annular dielectric ring portion, of the dielectric substrate 20, that surrounds the first through-hole 16 that feeds, or is coupled to, the first antenna element 10. In one embodiment, the first antenna element 10 is coupled to an input port (e.g., first input port) of a second combiner 38, via one or more conductive traces on a lower side of dielectric substrate 20 or integrated into or within a circuit board 22 (e.g., multi-layer circuit board).

The conductive ground plane 18 may be formed of metal or a metal alloy, such as copper or a copper alloy, for example. In one embodiment, an electrically conductive lower ground plane 32 is disposed on an opposite site or lower side of the dielectric substrate 20 or circuit board 22; the first antenna element 10 is electrically isolated from the lower ground plane 32. On a lower side of the dielectric substrate 20, conductive traces (e.g., metallic traces) form connections or support coupling: (a) between the first antenna element 10 and an input port of the second combiner 38 (in FIG. 2); (b) between the second antenna elements 24 and corresponding input ports of the first combiner 34 (in FIG. 2).

As illustrated in FIG. 1, the antenna system 11 is constructed on a circuit board 22, such as a rectangular circuit board composed of a polymer, a plastic, a plastic composite, a polymer composite, or ceramic material. In one embodiment, the first antenna element 10 (e.g., vertical monopole) is mounted in the center of the circuit board 22.

In an alternate embodiment, the vertical monopole may comprise a cylindrical whip antenna mounted above or on a ground plane.

Although the first antenna element 10, or vertical monopole, may have other heights that fall within the scope of the appended claims, in one configuration the first antenna element 10 has a height 12 of approximately one-quarter wavelength at the target wavelength range. In another configuration, the first antenna element 10 has a height 12 of approximately 70 millimeter and wherein the target wavelength range is the wavelength associated with the GPS satellite signals (e.g., 0.19 meters to 0.26 meters), GLONASS satellite signals, Galileo satellite signals, or other available global navigation satellite signals. For example, the GPS satellite signals operate at the following frequency ranges: L1 (1,575.42 MHz), L2 (1,227.6 MHz) and L5 (1,176.45 MHz), where the wavelength can be derived in accordance with the following well known equation: $\lambda=c/f$ where $\lambda$ refers to the wavelength in meters, c refers to the speed of light in meters per second (e.g., 299,792,458) and f refers to the frequency in Hertz.

The antenna height 12 of 70 millimeters (of the first antenna element 10) keeps the overall antenna system 11 compact. Further, the antenna height 12 may be commensurate with or equivalent to the aggregate antenna height of the entire antenna system 11. If the height 12 of the first antenna element 10 is less than 70 millimeter or an equivalent critical height for the target wavelength range, then the coupling between the second antenna elements 24 (e.g., Inverted-F elements (e.g., 24) and the first antenna element 10 (e.g., monopole) can become excessive and interfere with impedance matching to the transmission line (e.g., 50 ohms or 75 ohms) at the target wavelength range. If the height 12 of the first antenna element 10 were increased to one quarter-wave length, the impedance matching is facilitated, but the antenna system 11 would have a height 12, size or volume (e.g., under a protective dielectric enclosure or radome) that may be too large for customer or consumer convenience or market acceptance.

In one embodiment, each of the second antenna elements 24 comprises an inverted-F antenna element oriented outside a perimeter 30 of a conductive ground plane 18 about (or for) the first antenna element 10. Further, as illustrated in FIG. 1, each inverted-F element comprises a main strip 25 with a first branch strip 26 and a second branch strip 27 extending from the main strip 25 at a generally orthogonal angles 51.

For example, each inverted-F element (e.g., 24) can be fed at a central feed point 29 or centrally fed at or near an end (e.g., termination) of the first branch strip 26 (e.g., central branch strip). The inverted-F element (e.g., 24) can be centrally fed to the feed point 29 via or by a second through-hole 28. For example, the second through-hole 28 may comprise a conductive through-hole, or a conductive via in the dielectric substrate 20. As shown, the main strip 25 and the second branch strip 27 are not fed, or could be considered as fed indirectly through the first branch strip 26 and the main strip 25. The electrical insulation or isolation, with respect to any second antenna element 24 and a corresponding second through-hole 28 that is electrically coupled to the second antenna element 24, may be established by an annular dielectric ring portion, of the dielectric substrate 20, that surrounds any second through-hole 28 that feeds, or is coupled to, the respective second antenna element 24. In one embodiment, the second antenna elements 24 are coupled to input ports of a first combiner 34 via a series of conductive traces on a lower side of the dielectric substrate 20, or integrated into or within a circuit board 22 (e.g., multi-layer circuit board).

As illustrated in FIG. 1, a plurality or array of inverted-F elements (e.g., 24) oriented in a ring or loop about a vertical axis 13 of the monopole, where in the ring or loop, each inverted-F element (e.g., 24) is rotated approximately ninety (90) degrees with respect to any adjacent inverted-F element. The effect of arranging array of (four) inverted-F elements or substantially equivalent elements in a ring is to produce an electromagnetic field, such as an electric field (e.g., E-field) which is polarized in the radial direction. For example, FIG. 3 illustrates an electric field that is polarized in a radial direction or radial directions within the a generally horizontal plane 19 or a plane defined by the intersection of the lateral axis 15 (e.g., X-axis) and depth axis 17 (e.g., Y-axis).

The inverted-F element (e.g., 24) is a generally planar antenna geometry that can be aligned with or generally parallel to the horizontal plane 19 defined by a substantially planar dielectric substrate 20 or the circuit board 22. As illustrated in FIG. 1, the inverted-F elements (e.g., 24) define or lie within a generally horizontal plane 19, associated with the lateral axis 15 (e.g., X-axis) and depth axis 17 (e.g., Y-axis).

Although each inverted-F element (e.g., 24) is generally not characterized as a wide-bandwidth element or a wide-band radiating device, each inverted-F element (e.g., 24) can be matched to a target impedance (e.g., 50 ohms or 75 ohms) at a desired frequency band or target wavelength (e.g., sufficient for ample performance for various satellite navigation receiver bands) by adjusting the length and width of its constituent strips or segments, such as one or more of the following: the main strip 25, the first branch strip 26 and the second branch strip 27. Because the inverted F-element (e.g., 24) has a generally planar geometry, the inverted-F elements can be fabricated using conventional circuit-board fabrication techniques, such as photolithography, photosensitive processes, chemical etching, chemically resistive barriers, metallization, metal deposition, electroless deposition, sputtering or adhesively bonding of metal films, among other possible processes.

FIG. 2 is a block diagram of one embodiment of an antenna system 11 that illustrates the combining network 35 of the antenna system 11. In one embodiment, the combining network 35 comprises a first combiner 34, a second combiner 38 and a phase delay device 36. The first combiner 34 (hybrid combiner) is coupled to the second antenna elements 24. The first combiner 34 is configured to combine the radially polarized electromagnetic signal components 303 to produce the aggregate radially polarized electromagnetic signal.

The second combiner 38 is coupled to the first antenna element 10 and the phase delay device 36. The second combiner 38 is configured to combine the vertically polarized electromagnetic signal component 301 with the delayed aggregate radially polarized electromagnetic signal component (e.g., derived from multiple radially polarized signal components 303) to yield the circularly polarized radiation pattern (e.g., radiation pattern 45 in FIG. 4).

The phase delay device 36 is configured for delaying a phase offset of the aggregate radially polarized electromagnetic signal to achieve a target phase offset between the vertically polarized electromagnetic signal component 301 and the aggregate radially polarized signal component. The phase delay device 36 may be configured to delay the phase in accordance with various techniques, which may be applied separately or cumulatively. Under a first technique, the target phase delay is approximately forty (40) degrees. Under a second technique, the target phase delay is selected to produce a target phase delay of approximately ninety (90) degrees between the vertically polarized electromagnetic signal component 301 and a delayed aggregate radially polarized electromagnetic signal component, which is derived from the combination of multiple radially polarized electromagnetic signal components 303.

In FIG. 2, the combining network 35 combines the electromagnetic signals, such as received satellite signals, from the first antenna element 10 and the array of second antenna elements 24 (e.g., four second antenna elements 24 arranged in a ring around a vertical axis 13 (e.g., Z-axis). For example, the satellite signals received by antenna elements (10, 24) are combined electrically to produce a single aggregate output signal for input or application to a satellite navigation receiver or receiver 40. In one embodiment, the receiver comprises a low-noise amplifier (LNA). The receiver 40 is indicated in dashed lines because it is optional and not separate from the antenna system 11.

In FIG. 2, the combining network 35 comprises a two-stage network of a first combiner 34 and a second combiner 38. In one configuration, the first combiner 34 first combines the array of second antenna elements 24, such as the four inverted-F element (e.g., 24) outputs, into an aggregate radially polarized electromagnetic signal. The second antenna elements 24 are coupled to corresponding input ports of the first combiner 34, whereas an output port of the first combiner 34 is coupled to an input port of the phase delay device 36.

The phase delay device 36 shifts, retards or delays a phase of the aggregate radially polarized electromagnetic signal with a target phase shift to ensure that the radial and the vertical E-fields will be apart by approximately ninety (90) degrees (in the far field) for reception by satellite receivers in a real world environment. As used in this document, approximately shall mean plus or minus 10 percent or 10 degrees. In one configuration, an electrical delay of approximately forty (40) degrees for the inverted-F signals will result in a separation between the radial and vertical E-fields of approximately ninety (90) degrees in the far field pattern. The phase delay device 36 produces the target phase shift at the target frequency range between an input port of the phase delay device 36 and an output port of the phase delay device, for instance.

The second combiner 38 combines the phase-delayed aggregate radially polarized electromagnetic signal (from the output of the phase delay device 36) with the vertically polarized electromagnetic signal of the first antenna element 10, such as the vertical monopole output. For example, one input port of the second combiner 38 receives the phase-delayed aggregate radially polarized electromagnetic signal (from the output of the phase delay device 36), whereas the other input port of the second combiner receives the vertically polarized electromagnetic signal from the first antenna element 10. The second combiner 38 has an output port that provides the circularly polarized electromagnetic signal from received satellite signal, such as from one or more satellites that orbit the Earth.

Figure 4:
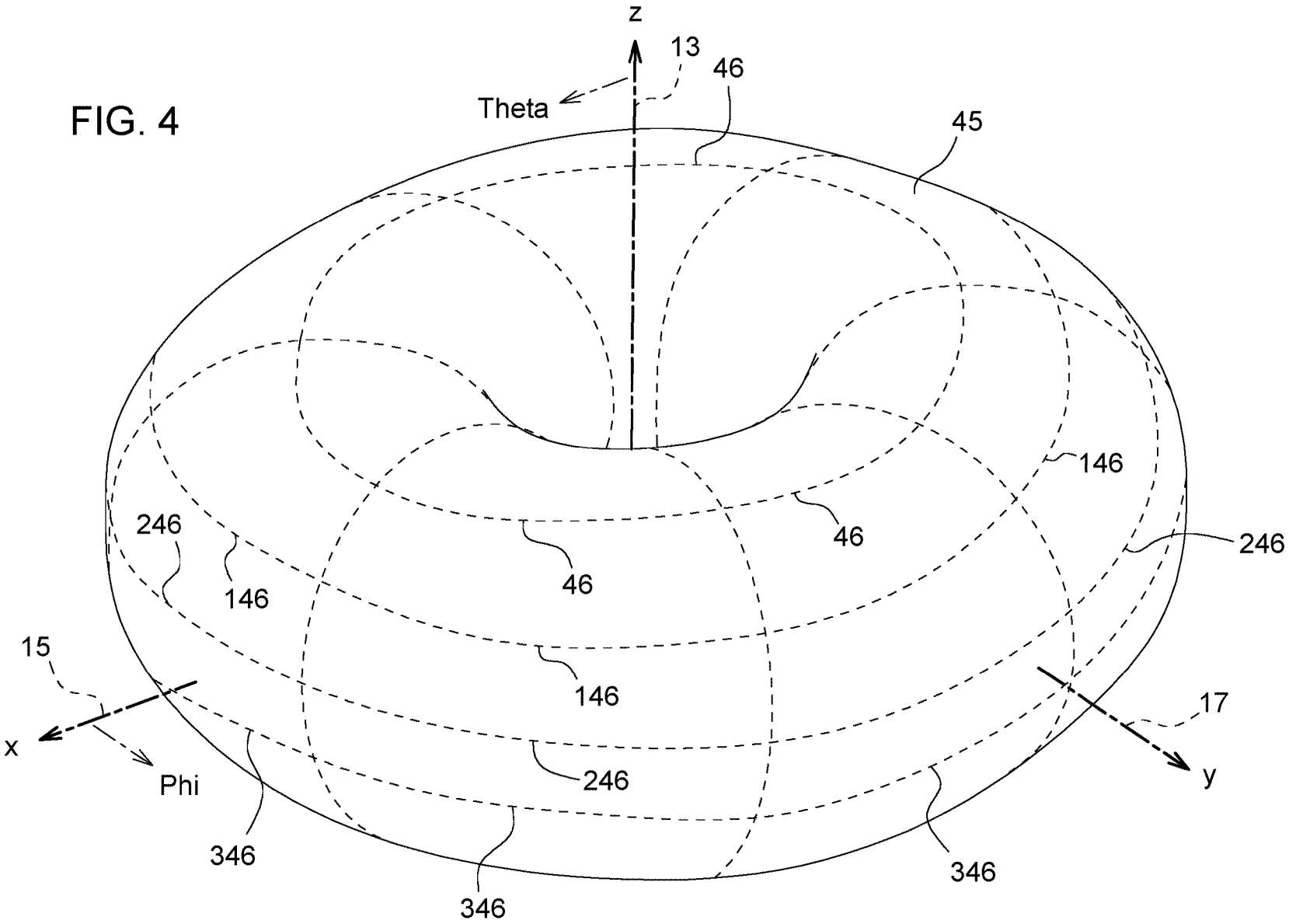
FIG. 4 illustrates an illustrative pattern for circularly polarized radiation, where on the illustrated three-dimensional surface lie contour curves of different corresponding uniform field strengths for one embodiment of an antenna.

FIG. 3 illustrates the electromagnetic field (e.g., electric field) contributions from a first element 10 and array of second elements 24 in one embodiment of the antenna system 11. A circularly polarized wave can be thought of as the combination of a vertically polarized and a horizontally polarized wave with the same direction of propagation and a difference in phase of approximately ninety (90) degrees between them. Such a wave can be generated by a pair of crossed dipole elements, where the gain pattern will be conical in shape rather than the more desired disk-like shape of a circularly polarized radiation pattern 45, which is illustrated in FIG. 4. To produce a targeted disk radiation pattern, the antenna system 11 can use a vertically polarized and a radially polarized wave as two orthogonal constituent waves, as described in this document.

FIG. 3 illustrates one possible illustrative example of the relative orientation of two electric field components (301, 303) with respect to the vertical axis 13 (Z-axis), the lateral axis 15 (X-axis), and depth axis 17 (Y-axis). If these constituent electric fields (301, 303) are the same amplitude and approximately ninety (90) degrees apart in phase at some point away from the antenna system 11, then the resulting reception or transmission radiation pattern (e.g., radiation pattern 45 in FIG. 4) will be circularly polarized. More generally, the geometric relation between the two field sources ensures that anywhere on the z=0 plane the following conditions will be met: (a) the vertical field and the radial field will be substantially orthogonal in polarization; (b) the vertical field and the radial filed will be the substantially the same amplitude (e.g., plus or minus some tolerance, such as ten percent); (c) the vertical field and the radial field will differ in phase by approximately ninety (90) degrees. As described in this document, a combination of first antenna element 10 and the array of second antenna element 24 can be used to generate the illustrated relationship between these two orthogonal waves to yield a circularly polarized radiation pattern that is well-suited for microwave, radio and satellite communication systems. For example, the first antenna element 10 comprises a vertical monopole for reception or transmission of the generally vertically polarized signal or wave; the array of second antenna elements 24 (e.g., four inverted-F element (e.g., 24) is configured to produce the radially polarized signal or wave for combination with the vertically polarized signal.

As best illustrated in FIG. 4, the circularly polarized radiation pattern 45 (e.g., right hand circularly polarized radiation pattern) of the antenna system 11 has a disc-shaped or toroidal radiation pattern 45, which is desirable for reception of geosynchronous satellite signals when a satellite receiver 40 is positioned at higher latitudes (e.g., near to the North or South pole). Here, each radiation gain contour, such as any one of curved dashed lines or elliptical paths (46, 146, 246, 346), represents a different uniform gain level that lies on the surface of radiation pattern 45 and that is uniform in at least two dimensions. For a ground-based receiver of a satellite-to-ground transmission to have the best sensitivity, its antenna system 11 needs to have a high isotropic gain. Because the beam width decreases with increasing gain of the radiation pattern 45, the beam shape of the radiation pattern 45 of the antenna system 11 is strategically chosen to ensure that the transmitting satellite remains in the beam of the receive antenna. An approximately hemispherical radiation pattern works well for GPS receive antennas because the satellites are located overhead and the transmit power is high enough that a low antenna gain is sufficient. To produce a disk radiation pattern 45, the antenna system 11 can use a vertically polarized and a radially polarized wave to combine, mix, add, or otherwise interact with the two orthogonal constituent waves.

In FIG. 4, the generally circularly polarized (CP) radiation pattern 45 is consistent with gain pattern of a generally linearly polarized (LP) monopole antenna. For example, the CP gain at the horizon, which corresponds to gain contour 246, is better than 1.5 dBi (decibels-isotropic, or decibels relative to isotropic gain), making it well-suited for reception of satellite signals by users at higher latitudes with respect to the geostationary satellite that orbits about the equator of Earth. By comparison, the gain of 1.5 dBi at the horizon for antenna system 11 is at least 3 dB (decibels) higher than a typical crossed dipole or a patch antenna. Because of the disc-shaped or toroidal shape of the radiation pattern 45, the gain decreases at lower latitudes. Accordingly, for certain applications, the antenna system 11 may be reoriented by rotating the toroidal radiation pattern approximately ninety (90) degrees for receiving signals from a geostationary satellite when at lower latitudes near the equator, or the antenna system 11 can be used in conjunction with (e.g., combined, selectively coupled to, or switchably coupled to) another antenna that has an approximately hemispherical radiation pattern.

Figure 5:
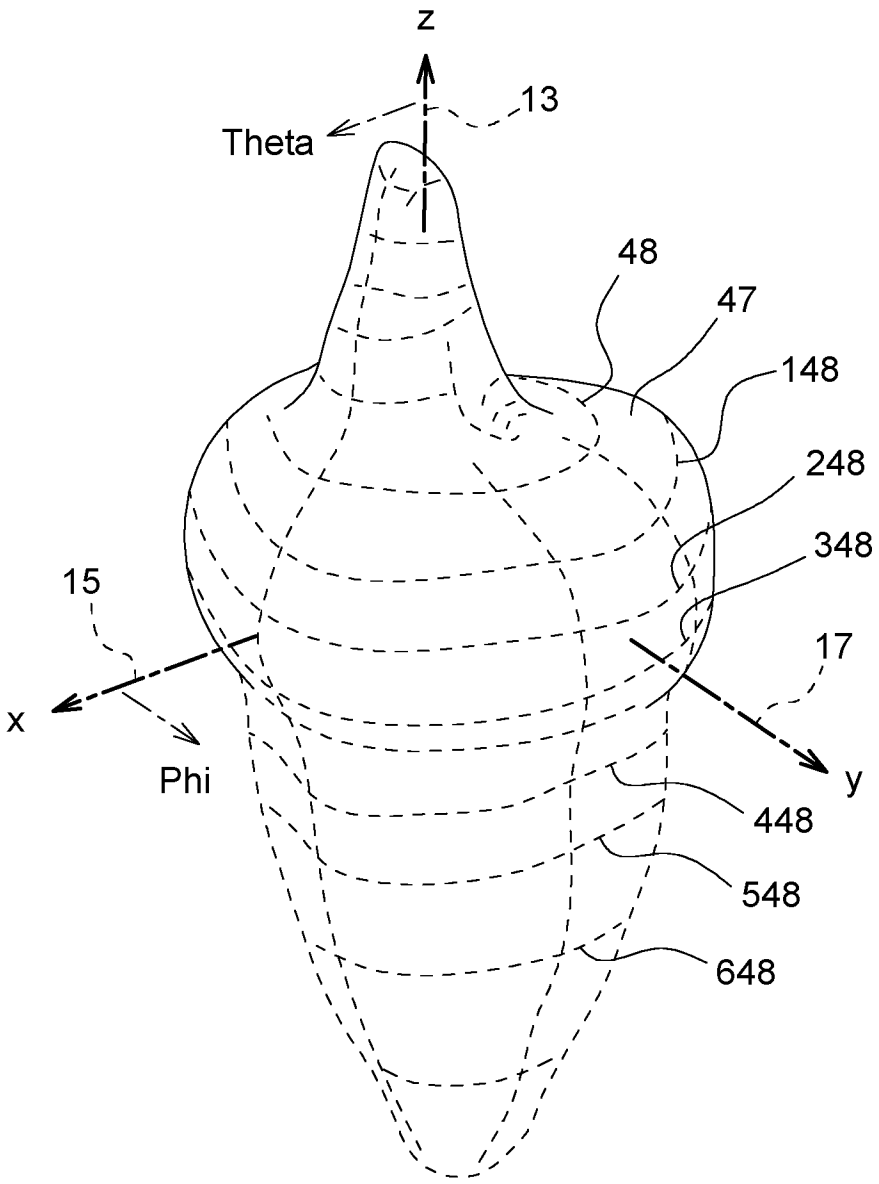
FIG. 5 illustrates an axial-ratio radiation pattern, where on the illustrated three-dimensional surface lie contour curves of different corresponding uniform axial ratio for one embodiment of an antenna system.

FIG. 5 illustrates an axial-ratio (AR) radiation pattern 47, where on the illustrated three-dimensional surface lie contour curves of different corresponding uniform field strengths of an axial ratio for one embodiment of an antenna system 11. Here, each radiation AR contour, such as any one of curved dashed lines or elliptical paths (48, 148, 248, 348, 448, 548, 648), represents a different uniform AR level that lies on the surface of radiation pattern 47 and that is uniform AR in at least two dimensions. Axial ratio is a parameter used to assess the quality of the circular polarization of the radiation pattern 45 (in FIG. 4). An AR of zero dB indicates a perfect circularly polarized reception, while an AR of greater than 15 dB is closer to linear polarization than circular polarization.

FIG. 5 shows a three-dimensional axial-ratio radiation pattern 47 or plot of AR for the circularly polarized antenna system 11. As illustrated, the AR contour of radiation pattern 47 is about 5 dB for low elevations above the horizontal plane 19; the AR contour drops to 4 dB at higher elevations above the horizontal plane 19; the AR contour increases again for very high elevations above the horizontal plane 19. The AR radiation pattern 47 verifies and demonstrates that the antenna system 11 does indeed have a circularly polarized radiation pattern.

While the disclosure has been illustrated and described in detail in the drawings and foregoing description, such illustration and description is to be considered as exemplary and not restrictive in character, it being understood that illustrative embodiments have been shown and described and that all changes and modifications that come within the spirit of the disclosure are desired to be protected. It will be noted that alternative embodiments of the present disclosure may not include all of the features described yet still benefit from at least some of the advantages of such features. Those of ordinary skill in the art may readily devise their own implementations that incorporate one or more of the features of the present disclosure and fall within the spirit and scope of the present invention as defined by the appended claims.

The following is claimed:

1. An antenna system comprising:

a first antenna element for radiating or receiving a vertically polarized electromagnetic signal component within a target wavelength range, the first antenna element having a substantially vertical axis;

an array of second antenna elements for radiating or receiving an aggregate radially polarized electromagnetic signal component within the target wavelength range, the aggregate radially polarized electromagnetic signal being derived from radially polarized signal components associated with corresponding ones of the second antenna elements, where the array defines a substantially horizontal plane that is generally orthogonal to the substantially vertical axis of the first antenna element; and a combining network for combining the received vertically polarized electromagnetic signal component and the aggregate radially polarized signal component such that the first antenna element, the array and the combining network cooperate to yield or receive a radiation pattern that is generally circularly polarized at the target wavelength range.

2. The antenna system according to claim 1 wherein the first antenna element comprises a substantially vertical monopole that is associated with a ground plane on a dielectric substrate.

3. The antenna system according to claim 2 wherein the substantially vertical monopole is bottom fed and electrically insulated from the ground plane.

4. The antenna system according to claim 2 wherein the substantially vertical monopole has a height of approximately one-quarter wavelength at the target wavelength range.

5. The antenna system according to claim 2 wherein the substantially vertical monopole has a height of approximately 70 millimeters and wherein the target wavelength range is the wavelength associated with at least the Global Positioning System (GPS) satellite signals.

6. The antenna system according to claim 1 wherein each of the second antenna elements comprises an inverted-F antenna element oriented outside a perimeter of a ground plane about or for the first antenna element.

7. The antenna system according to claim 6 wherein each inverted-F element is center-fed or centrally fed through a through-hole or conductive via in the substrate.

8. The antenna system according to claim 1 wherein the second antenna elements comprise:

a plurality of inverted-F elements oriented in a ring about a vertical axis of the monopole, where in the ring, each F-inverted element is rotated approximately ninety (90) degrees with respect to any adjacent F-element.

9. The antenna system according to claim 1 accordingly to claim 1 wherein the circularly polarized radiation pattern has a disc-shaped or toroidal radiation gain pattern for reception of geosynchronous satellite signals at higher latitudes.

10. The antenna system according to claim 1 wherein the combining network comprises:

a first combiner coupled to the second antenna elements, the first combiner configured to combine the radially polarized signal components to produce the aggregate radially polarized electromagnetic signal;

a phase delay device for delaying a phase offset of the aggregate radially polarized electromagnetic signal to achieve a target phase offset between the vertically polarized electromagnetic signal component and the aggregate radially polarized signal component;

a second combiner coupled to the first antenna element and the phase delay device; the second combiner configured to combine the vertically polarized electromagnetic signal component with the delayed aggregate radially polarized electromagnetic signal component to yield the circularly polarized radiation pattern.

11. The antenna system according to claim 10 wherein the target phase delay is approximately forty (40) degrees.

12. The antenna system according to claim 10 wherein the target phase delay is selected to produce a target phase delay of approximately ninety (90) degrees between the vertically polarized electromagnetic signal component and a delayed aggregate radially polarized electromagnetic signal component.

* * * * *